US009141012B2

(12) United States Patent
Moribe et al.

(10) Patent No.: US 9,141,012 B2
(45) Date of Patent: Sep. 22, 2015

(54) TONER

(71) Applicant: CANON KABUSHIKI KAISHA, Tokyo (JP)

(72) Inventors: Shuhei Moribe, Mishima (JP); Kosuke Fukudome, Tokyo (JP); Satoshi Mita, Mishima (JP); Kazuo Terauchi, Numazu (JP); Yojiro Hotta, Mishima (JP); Tetsuya Ida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/105,162

(22) Filed: Dec. 12, 2013

(65) Prior Publication Data

US 2014/0099577 A1 Apr. 10, 2014

Related U.S. Application Data

(63) Continuation of application No. PCT/JP2013/003766, filed on Jun. 17, 2013.

(30) Foreign Application Priority Data

Jun. 22, 2012 (JP) ..... 2012-141022

(51) Int. Cl.
*G03G 9/087* (2006.01)

(52) U.S. Cl.
CPC ..... *G03G 9/08755* (2013.01); *G03G 9/08795* (2013.01); *G03G 9/08797* (2013.01)

(58) Field of Classification Search
CPC ..... G03G 9/08755; G03G 9/08795; G03G 9/08797
USPC ..... 430/109.4
See application file for complete search history.

(56) References Cited

U.S. PATENT DOCUMENTS

| | | | |
|---|---|---|---|
| 5,665,513 | A | 9/1997 | Ida et al. |
| 5,700,617 | A | 12/1997 | Takiguchi et al. |
| 5,747,209 | A | 5/1998 | Takiguchi et al. |
| 5,795,693 | A | 8/1998 | Okado et al. |
| 5,851,714 | A | 12/1998 | Taya et al. |
| 5,912,099 | A | 6/1999 | Kanbayashi et al. |
| 5,994,018 | A | 11/1999 | Iida et al. |
| 6,001,525 | A | 12/1999 | Ida et al. |
| 6,013,402 | A | 1/2000 | Kanbayashi et al. |
| 6,022,659 | A | 2/2000 | Kanabayashi et al. |
| 6,146,801 | A | 11/2000 | Ichikawa et al. |
| 6,316,156 | B1 | 11/2001 | Takiguchi et al. |
| 6,528,222 | B2 | 3/2003 | Kohtaki et al. |
| 6,586,147 | B2 | 7/2003 | Iida et al. |
| 6,641,967 | B2 | 11/2003 | Takiguchi et al. |
| 6,751,424 | B2 | 6/2004 | Komatsu et al. |
| 6,808,852 | B2 | 10/2004 | Hotta et al. |
| 6,875,549 | B2 | 4/2005 | Yamazaki et al. |
| 6,881,527 | B2 | 4/2005 | Moribe et al. |
| 6,929,894 | B2 | 8/2005 | Sugahara et al. |
| 7,001,703 | B2 | 2/2006 | Moribe et al. |
| 7,022,449 | B2 | 4/2006 | Sugahara et al. |
| 7,097,951 | B2 | 8/2006 | Moribe et al. |
| 7,112,395 | B2 | 9/2006 | Ida et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,244,539 | B2 | 7/2007 | Baba et al. |
| 7,267,919 | B2 | 9/2007 | Moribe et al. |
| 7,273,686 | B2 | 9/2007 | Onuma et al. |
| 7,288,348 | B2 | 10/2007 | Hayami et al. |
| 7,288,354 | B2 | 10/2007 | Moribe et al. |
| 7,300,733 | B2 | 11/2007 | Sugahara et al. |
| 7,351,509 | B2 | 4/2008 | Moribe et al. |
| 7,422,832 | B2 | 9/2008 | Ogawa et al. |
| 7,452,647 | B2 | 11/2008 | Hayami et al. |
| 7,455,947 | B2 | 11/2008 | Ida et al. |

(Continued)

FOREIGN PATENT DOCUMENTS

| | | | |
|---|---|---|---|
| JP | 2002-72567 | A | 3/2002 |
| JP | 2006-113473 | A | 4/2006 |
| JP | 2007-33773 | A | 2/2007 |
| JP | 2007-127828 | A | 5/2007 |
| JP | 2008-241845 | A | 10/2008 |
| JP | 2010-38969 | A | 2/2010 |
| JP | 2010-102058 | A | 5/2010 |
| JP | 2010-152102 | A | 7/2010 |
| JP | 2012-53196 | A | 3/2012 |
| JP | 2012-234103 | A | 11/2012 |

OTHER PUBLICATIONS

PCT International Search Report and Written Opinion of the International Searching Authority, International Application No. PCT/JP2013/003766, Mailing Date Jul. 30, 2013.
Fedors, "A Method for Estimating Both the Solubility Parameters and Molar Volumes of Liquids", Polymer Engineering and Science, vol. 14, No. 2, 1974, pp. 147-154.
Fukudome, et al., U.S. Appl. No. 14/095,963, filed Dec. 3, 2013.
International Preliminary Report on Patentability, International Application No. PCT/JP2013/003766, Mailing Date Dec. 31, 2014.

*Primary Examiner* — Peter Vajda
(74) *Attorney, Agent, or Firm* — Fitzpatrick, Cella, Harper and Scinto

(57) ABSTRACT

The toner includes toner particles containing a polyester resin A, a polyester resin B and a colorant, the polyester resin A has a polyester portion including a segment capable of forming a crystal structure and a crystal nucleating agent segment, which is bonded to an end of the polyester portion, and the polyester resin B is a resin which is free of any segments capable of forming a crystal structure, the polyester resin B has a weight average molecular weight Mwb by GPC of a THF soluble matter of 3000 or more and 100000 or less, and an SP value Sa ($(cal/cm^3)^{1/2}$) of the polyester portion of the polyester resin A and an SP value Sb ($(cal/cm^3)^{1/2}$) of the polyester resin B satisfy the following relationships:

$$9.00 \leq Sa \leq 10.50$$

$$-0.40 \leq Sb - Sa \leq 0.80.$$

6 Claims, No Drawings

(56) References Cited

U.S. PATENT DOCUMENTS

| | | | |
|---|---|---|---|
| 7,537,877 | B2 | 5/2009 | Yoshiba et al. |
| 7,544,457 | B2 | 6/2009 | Hashimoto et al. |
| 7,611,813 | B2 | 11/2009 | Ida et al. |
| 7,629,100 | B2 | 12/2009 | Okamoto et al. |
| 7,638,251 | B2 | 12/2009 | Yamazaki et al. |
| 7,700,254 | B2 | 4/2010 | Moribe et al. |
| 7,767,370 | B2 | 8/2010 | Ishigami et al. |
| 7,816,063 | B2 | 10/2010 | Hashimoto et al. |
| 7,855,042 | B2 | 12/2010 | Kobori et al. |
| 7,906,262 | B2 | 3/2011 | Ishigami et al. |
| 8,057,977 | B2 | 11/2011 | Moribe et al. |
| 8,114,562 | B2 | 2/2012 | Ishigami et al. |
| 8,142,972 | B2 | 3/2012 | Hotta et al. |
| 8,216,754 | B2 | 7/2012 | Ikeda et al. |
| 8,431,304 | B2 | 4/2013 | Sugimoto et al. |
| 8,501,377 | B2 | 8/2013 | Takahashi et al. |
| 8,512,925 | B2 | 8/2013 | Moribe et al. |
| 2010/0248126 | A1 | 9/2010 | Ishigami et al. |
| 2011/0097661 | A1 | 4/2011 | Ishigami et al. |
| 2012/0052434 | A1* | 3/2012 | Sugimoto et al. ..... 430/108.8 |
| 2012/0107741 | A1* | 5/2012 | Hiraoka et al. ..... 430/137.12 |
| 2012/0189951 | A1* | 7/2012 | Sugimoto et al. ..... 430/108.2 |
| 2012/0288299 | A1 | 11/2012 | Uchinokura et al. |
| 2013/0244164 | A1 | 9/2013 | Fujikawa et al. |
| 2013/0244166 | A1 | 9/2013 | Yamazaki et al. |
| 2013/0252167 | A1 | 9/2013 | Moribe et al. |
| 2013/0288174 | A1 | 10/2013 | Shiotari et al. |
| 2013/0302730 | A1 | 11/2013 | Takahashi et al. |
| 2013/0309603 | A1 | 11/2013 | Takahashi et al. |
| 2013/0344430 | A1 | 12/2013 | Terauchi et al. |
| 2014/0038098 | A1 | 2/2014 | Naka et al. |
| 2014/0051023 | A1 | 2/2014 | Hotta et al. |
| 2014/0099578 | A1 | 4/2014 | Hotta et al. |

* cited by examiner

TONER

CROSS-REFERENCE TO RELATED APPLICATIONS

This application is a continuation of International Application No. PCT/JP2013/003766, filed Jun. 17, 2013, which claims the benefit of Japanese Patent Application No. 2012-141022, filed Jun. 22, 2012.

BACKGROUND OF THE INVENTION

1. Field of the Invention

The present invention relates to a toner for use in electrophotography, an image forming method for visualizing an electrostatic charge image and a toner jet.

2. Description of the Related Art

In order to reduce the power consumption and shorten the wait time of an electrophotographic apparatus, an on-demand type fixing apparatus obtained by combining a ceramic heater with a small thermal capacity and a film has been put to practical use as a fixing apparatus. In such a fixing apparatus, attempts have been made to reduce a fixing nip internal pressure thereof from the viewpoint of elongation of the lifetime and applicability to a variety of media.

Furthermore, according to recent increase in a print speed, time when a toner and a medium such as paper pass through a nip of a fixing apparatus has become shorter year by year.

Moreover, there are recently increasing opportunities for a user to output, by using an image forming apparatus such as a laser beam printer (LBP), a graphic image with a high coverage rate such as image data taken through a digital camera, a portable terminal or the like, or a poster.

In this context, there is a demand for a toner capable of showing an excellent low temperature fixing property even under severer fixing conditions, for example, conditions for forming an image with a high coverage rate in a short period of time with a low nip internal fixing pressure. For purpose of meeting such conditions, a large number of toners using a crystalline resin as a binding resin have been proposed.

Japanese Patent Application Laid-Open No. 2010-102058 describes that a crystalline resin is rapidly molten at a temperature in the vicinity of glass transition temperature thereof, and that a low temperature fixing property of a toner can be improved by increasing the compatibility between a crystalline resin and an amorphous resin. When the compatibility therebetween is too high, however, the resulting toner is degraded in the heat-resistant storage property and the crystallizability on the contrary.

In contrast, when the compatibility between an amorphous resin and a crystalline resin is lowered, the crystal of the crystalline resin is liable to be easily formed, but these resins are hard to be compatible with each other even at a temperature over melting points thereof, and hence, it is difficult to improve the low temperature fixing property particularly when a fixing time is short or a nip internal pressure is low.

Japanese Patent Application Laid-Open No. 2010-152102 describes that recrystallization of a crystalline resin is accelerated by additionally performing a step of conducting a heat treatment at a specific temperature in a production process for a toner. When the method described in Japanese Patent Application Laid-Open No. 2010-152102 is employed, a toner containing crystal of the crystalline resin can be definitely obtained. If the toner is once molted in a fixing step, however, the crystalline resin and an amorphous resin are completely compatibilized and can never be restored to an original crystalline state, and therefore, a toner image obtained after fixing may be blocked under a severe environment of high temperature and high humidity.

Meanwhile, a method for accelerating crystallization of a crystalline resin by adding a crystal nucleating agent to a toner has been proposed. Japanese Patent Application Laid-Open No. 2007-033773 describes use of an inorganic crystal nucleating agent of fine particles of silica or the like as the crystal nucleating agent. Also, Japanese Patent Application Laid-Open No. 2006-113473 describes use of an organic crystal nucleating agent of a metal benzoate, fatty amide or the like as the crystal nucleating agent. If the content of an inorganic crystal nucleating agent of silica or the like is large, however, the crystal nucleating agent may show a filler effect to increase the melt viscosity of a resulting toner, which may inhibit the low temperature fixing property. Besides, an inorganic crystal nucleating agent affects a charging characteristic of the toner, and hence, a charging property of the toner may be difficult to control in many cases. On the other hand, an organic nucleating agent is a low molecular compound such as a metal benzoate or a fatty acid metal salt in many cases, and such a nucleating agent is segregated on the surface of the toner and shows an insufficient effect as the crystal nucleating agent. As a result, the storage property of the toner may be degraded or the storage stability of a toner image may be degraded in some cases.

Moreover, even though a part of crystal is recrystallized after fixing, the crystal is in an incomplete crystalline state. Therefore, if the fixed image is left to stand for a long period of time, phase separation is caused between a crystal portion and a compatible portion, and due to volume shrinkage occurring in the crystal portion, the fixed image may curl in some cases.

In this manner, there still remains a room for improvement for attaining both excellent low temperature fixing performance and long-term storage stability of a fixed image.

SUMMARY OF THE INVENTION

The present invention is directed to providing a toner showing an excellent fixing property even under severe fixing conditions, for example, where rapid development is performed and a fixer having a structure with a low fixing nip internal pressure is employed. Further, the present invention is directed to providing a toner showing excellent storage stability in the form of a fixed image in which peeling of a fixed image and curl of a transfer medium may be suppressed even when stored for a long period of time.

According to one aspect of the present invention, there is provided a toner comprising toner particles, each of which contains a polyester resin A, a polyester resin B and a colorant, in which the polyester resin A contains a polyester portion having a segment capable of forming a crystal structure, and a crystal nucleating agent segment, which is bonded to an end of the polyester portion, the polyester resin B is a resin which is free of any segments capable of forming a crystal structure, a tetrahydrofuran (THF) soluble matter of the polyester resin B has a weight average molecular weight Mwb of 3000 or more and 100000 or less. And an SP value of the polyester portion of the polyester resin A is represented by Sa $((cal/cm^3)^{1/2})$ and an SP value of the polyester resin B is represented by Sb $((cal/cm^3)^{1/2})$, the SP values Sa and Sb satisfy the following relationships:

$$9.00 \leq Sa \leq 10.50; \text{ and}$$

$$-0.40 \leq Sb - Sa \leq 0.80.$$

DESCRIPTION OF THE EMBODIMENTS

In order to fix an image having a large toner carrying amount, such as a graphic image, rapidly and at a low pressure, it is necessary, in a fixing operation, for a toner disposed in an upper layer of the image and a toner disposed in a lower layer of the image to be instantly molten so as to be fixed on a recording medium. For this purpose, the toner is required to have a sharp melt property.

In the present invention, a polyester resin A having a crystal nucleating agent segment bonded to an end of a polyester portion capable of forming a crystal structure and a polyester resin B which is free of any segments capable of forming a crystal structure are used. In the present invention, a segment capable of forming a crystal structure means a segment having an endothermic peak in temperature rise and an exothermic peak in temperature fall in measurement with a differential scanning calorimeter (DSC), and the measurement is performed according to the measurement method of "ASTM D3418-82".

In the present invention, a difference in the SP values between the polyester portion of the polyester resin A and the polyester resin B is controlled to attain the effects of the present invention. The present inventors presume the reason as follows.

When the toner of the present invention is heated in a fixing operation, the polyester resin B is plasticized by the polyester resin A, and the polyester resin A and the polyester resin B become compatible with each other. Therefore, the glass transition temperature (Tg) of the toner is largely lowered, the melt viscosity is also lowered, and hence the low temperature fixing property of the toner is improved. Meanwhile, before a fixing operation or in a fixed image having been fixed on a recording medium, phase separation is caused between the polyester resin A and the polyester resin B in the toner, and the polyester resin A has high crystallizability. In other words, in the toner of the present invention, reversible phase transition of the polyester resins can be caused.

Furthermore, the toner of the present invention has a characteristic in which the state change between a compatible state at a high temperature and a phase separation state at room temperature can be caused in extremely short time. Accordingly, the polyester resin A and the polyester resin B in the compatible state in a fixing operation rapidly recover phase separated structures after fixed on a recording medium.

Incidentally, the polyester resins A and B being compatible with each other at room temperature can be a factor to degrade the heat-resistant storage property of the toner. Furthermore, if a compatible portion is present in a large amount in the toner present in a fixed image, the long-term storage stability of the fixed image is degraded.

In order to increase the crystallinity of the polyester resin A, an SP value Sa ($(cal/cm^3)^{1/2}$) of the polyester portion of the polyester resin A should be 9.00 or more and 10.50 or less. Incidentally, the value Sa can be 9.70 or more and 10.20 or less. In the polyester resin A, a low SP value means that the number of carbon atoms of aliphatic carboxylic acid and/or aliphatic alcohol contained in the polyester resin A is large.

From the viewpoint of increasing the crystallinity of the polyester portion of the polyester resin A, a larger number of carbon atoms, namely, a lower SP value, is preferred. If the SP value of the polyester portion of the polyester resin A is too low, however, the compatibility with the polyester resin B in a fixing temperature region is degraded. Accordingly, if the value Sa is lower than 9.00, the polyester resin A and the polyester resin B are not compatible with each other in a fixing operation, and hence, a low temperature fixing property attained in a rapid development system (high speed fixing property) cannot be sufficient. On the other hand, if the value Sa is higher than 10.50, the polyester resin A and the polyester resin B are compatible with each other almost in a complete state in a fixing operation, and therefore, the toner present in a fixed image is poor in an image storage property at a high temperature, and particularly when the image is bent, the image can be easily peeled off.

This is probably for the following reason: If the toner is present in a fixed image in a compatible state, the Tg of the toner present in the fixed image is lowered, and therefore, the melt viscosity of the toner present in the image is rather lowered in a high temperature environment. As a result, when the image is bent, adhesive force between paper and the toner is lowered and hence the toner is easily peeled off.

Incidentally, an SP value employed in the present invention is calculated on the basis of the kinds and proportions of monomers contained in a resin according to a generally employed method of which some are described in Fedors [Poly. Eng. Sci., 14(2) 147 (1974)], such as Dunkel, Bowden and Jones, Small, and Rheineck and Lin.

In order to increase the crystallinity of the polyester portion of the polyester resin A, it is necessary to make the crystal nucleating agent segment bonded to an end of the polyester portion in addition to the adjustment of the SP values as described above.

In general, a crystal segment is formed when crystal grows after a crystal nucleus is formed. In the present invention, since the crystal nucleating agent is contained at the end of the polyester portion, crystal growth can be accelerated in the segment capable of forming a crystal structure (hereinafter sometimes referred to as the segment a), and the speed of crystallization of the polyester resin A can be improved. If no crystal nucleating agent is bonded to the polyester portion, the speed of the crystal growth of the polyester resin is so low that the reversible phase transition of the toner cannot be caused. Alternatively, if a crystal nucleating agent is present in a polymer without bonding thereto, since the crystal nucleating agent is generally a low molecular compound, the agent is liable to deposit on the surface of the toner, and hence, there is a possibility of degradation of the heat-resistant storage property of the toner.

A nucleating agent used for forming the crystal nucleating agent segment is not especially limited as long as the crystal nucleating agent is a compound having a higher crystallization speed than the segment a. However, from the viewpoint of a high crystallization speed, a compound that has a principal chain containing a hydrocarbon segment and has one or more functional groups reactive with the end of the polyester portion is preferably used. A compound that has a linear hydrocarbon segment and has one functional group reactive with the polyester portion is more preferably used. From the viewpoint of improvement in reactivity between the crystal nucleating agent and the end of the polyester portion, the molecular weight of the crystal nucleating agent is preferably 100 to 10,000 and more preferably 150 to 5,000.

The nucleating agent is not especially limited as long as the crystal nucleating agent can be bonded to the end of the polyester portion, and can be an aliphatic carboxylic acid having 10 or more and 30 or less carbon atoms and/or an aliphatic alcohol having 10 or more and 30 or less carbon atoms. A crystal nucleating agent having a given number or more carbon atoms is preferred because such a nucleating agent provides higher crystallinity, provides higher molecular mobility than the segment a of the polyester resin A and can increase the crystallization speed as the crystal nucleus.

From the viewpoint of the improvement of the crystallization speed, the crystal nucleating agent can be contained in the polyester resin A in a content of 0.1 part by mol or more and 7.0 parts by mol or less, and preferably 0.2 part by mol or more and 5.0 parts by mol or less based on 100 parts by mol of raw material monomers of a polyester molecular chain of the polyester resin A. If the content falls in this range, the compatibility between the polyester resin A and the polyester resin B can be appropriately adjusted, and the image peeling caused in bending a fixed image can be suppressed. In particular, even in an image forming apparatus in which a fixing operation is performed with a low fixing pressure, a good fixing property (low pressure fixing property) can be attained.

It is determined through the following analysis whether or not the crystal nucleating agent is bonded to the polyester portion.

A sample solution is prepared by precisely weighing 2 mg of a sample and dissolving the weighed sample in 2 ml of chloroform added thereto. The polyester resin A is used as a resin sample, but if the polyester resin A is not easily available, a toner containing the polyester resin A can be used instead as a sample. Next, a matrix solution is prepared by precisely weighing 20 mg of 2,5-dihydroxybenzoic acid (DHBA) and dissolving the weighed DHBA in 1 ml of chloroform added thereto. Furthermore, an ionization assistant solution is prepared by precisely weighing 3 mg of Na trifluoroacetate (NaTFA) and dissolving the weighed NaTFA in 1 ml of acetone added thereto.

A measurement sample is obtained by mixing 25 μl of the sample solution, 50 μl of the matrix solution and 5 μl of the ionization assistant solution thus prepared, dropping the resulting mixture onto a sample plate for an MALDI analysis and drying the dropped mixture. A mass spectrum is obtained by using MALDI-TOFMS (manufactured by Bruker Daltonics, Reflex III) as an analyzer. In the thus obtained mass spectrum, assignment of respective peaks in an oligomer region (with m/Z of 2000 or less) is obtained, so as to determine whether or not there is a peak corresponding to a composition of the crystal nucleating agent bonded to a molecular end.

In order to obtain a structure in which the reversible phase transition can be caused in the polyester resin A and the polyester resin B, it is necessary, in addition to the use of the crystal nucleating agent, to attain a specific relationship between the SP value of the polyester portion of the polyester resin A and the SP value of the polyester resin B. Specifically, the SP value Sa of the polyester portion of the polyester resin A and the SP value Sb of the polyester resin B are required to satisfy the following relationship:

$$-0.40 \leq Sb - Sa \leq 0.80.$$

Furthermore, the SP value Sa of the polyester portion of the polyester resin A and the SP value Sb of the polyester resin B can satisfy the following relationship:

$$0.20 \leq Sb - Sa \leq 0.70.$$

An SP value (solubility parameter) is conventionally used as an index corresponding to easiness in mixing resins or mixing a resin and a wax, or the like. A value of Sb−Sa is an index corresponding to easiness in making the polyester resin A and the polyester resin B compatible with each other when thermally molten and in causing phase separation therein at room temperature. When the polyester resin A has the crystal nucleating agent segment at the end of the polyester portion and the value Sa and the value Sb satisfy the above relationship, the reversible phase transition can be caused. When the value Sa and the value Sb do not satisfy the above relationship, however, even if the polyester resin A has the crystal nucleating agent segment at the end of the polyester portion, the reversible phase transition cannot be caused.

If a difference between the SP values falls in the aforementioned range, the compatibility and the phase separation are well balanced, and therefore, in an image forming apparatus in which a fixing operation is performed with a low fixing pressure, a good fixing property (low pressure fixing property) can be attained. Furthermore, even when a fixed image is left to stand in a high temperature environment for a long period of time, the occurrence of the phase separation between a crystal portion and a compatible portion is suppressed in the toner forming the fixed image, and therefore, occurrence of curl of the fixed image can be suppressed.

A tetrahydrofuran (THF) soluble matter of the polyester resin B should have a weight average molecular weight Mwb measured by gel permeation chromatography (GPC) of 3000 or more and 100000 or less. The weight average molecular weight Mwb can be 4000 or more and 50000 or less. The weight average molecular weight Mwb is one of significant factors for the polyester resin A and the polyester resin B to form a reversible phase transition structure.

If the weight average molecular weight Mwb is smaller than 3000, the polyester resin A can easily get into the polyester resin B, and hence the polyester resin A and the polyester resin B can easily become compatible with each other. As a result, recrystallization of the toner in a fixed image after a fixing operation is liable to be insufficient, and curl is easily caused in an image when stored for a long period of time. On the other hand, if the weight average molecular weight Mwb is larger than 100000, the polyester resin A and the polyester resin B are easily placed in a phase separation state, and therefore, in using an image forming apparatus in which a fixing operation is performed with a low fixing pressure, a fixing property cannot be sufficiently attained.

As described so far, the reversible phase transition can be caused in the polyester resin A and the polyester resin B when the polyester resin A has the crystal nucleating agent segment at the end of the polyester molecular chain, and the SP values of the polyester portion of the polyester resin A and the polyester resin B and the weight average molecular weight of the polyester resin B are controlled to be in the prescribed ranges. As a result, even in an image forming apparatus in which a fixer with a low fixing pressure is used and rapid development is performed, a good fixing property can be attained, and even if a fixed image is stored for a long period of time under severe conditions, the occurrence of curl and the like of the image can be suppressed.

As an alcohol component used as a raw material monomer for the polyester resin A, aliphatic diols having 6 to 18 carbon atoms can be used from the viewpoint of improvement of the crystallizability of the polyester resin A. Especially, aliphatic diols having 6 to 12 carbon atoms can be used from the viewpoint of the fixing property and the heat-resistant stability. Examples of the aliphatic diols include 1,6-hexanediol, 1,7-heptanediol, 1,8-octanediol, 1,9-nonanediol, 1,10-decanediol, 1,11-undecanediol and 1,12-dodecanediol. The content of the aliphatic diol in the alcohol component can be 80 to 100 mol % from the viewpoint of further improving the crystallizability of the polyester resin A.

The alcohol component used for obtaining the polyester resin A may contain a polyvalent alcohol component other than the aliphatic diols. Examples include aromatic diols such as an alkyleneoxide addition product of bisphenol A represented by the following formula (I), including a polyoxypropylene addition product of 2,2-bis(4-hydroxyphenyl)propane and a polyoxyethylene addition product of 2,2-bis(4-hydroxyphenyl)propane; and tri- or more-valent alcohols such as glycerin, pentaerythritol and trimethylolpropane:

(I)

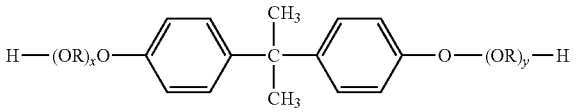

wherein R represents an alkylene group having 2 or 3 carbon atoms, x and y each represent a positive number, and a sum of x and y is 1 to 16 and preferably 1.5 to 5.

As a carboxylic acid component used as a raw material monomer for the polyester resin A, from the viewpoint of improving the crystallizability of the polyester resin A, aliphatic dicarboxylic acid compounds having 6 to 18 carbon atoms can be used. Especially, from the viewpoint of the fixing property and the heat-resistant stability of the toner, aliphatic dicarboxylic acid compounds having 6 to 12 carbon atoms can be used. Examples of the aliphatic dicarboxylic acid compounds include 1,8-octanedioic acid, 1,9-nonanedioic acid, 1,10-decanedioic acid, 1,11-undecanedioic acid and 1,12-dodecanedioic acid. The content of the aliphatic dicarboxylic acid compound having 6 to 18 carbon atoms in the carboxylic acid component can be 80 to 100 mol %.

The carboxylic acid component used for obtaining the polyester resin A may contain a carboxylic acid component other than the aliphatic dicarboxylic acid component. Examples include, but are not limited to, aromatic dicarboxylic acid compounds and aromatic polycarboxylic acid compounds having three or more valence. The aromatic dicarboxylic acid compounds include aromatic dicarboxylic acid derivatives. Specific examples of the aromatic dicarboxylic acid compounds include aromatic dicarboxylic acids such as phthalic acid, isophthalic acid and terephthalic acid, anhydrides of these acids, and alkyl (having 1 to 3 carbon atoms) esters thereof. Examples of an alkyl group contained in the alkyl esters include a methyl group, an ethyl group, a propyl group and an isopropyl group. Examples of the polycarboxylic acid compounds having three or more valence include aromatic carboxylic acids such as 1,2,4-benzenetricarboxylic acid (trimellitic acid), 2,5,7-naphthalenetricarboxylic acid and pyromellitic acid, and anhydrides of these acids, and derivatives thereof such as alkyl (having 1 to 3 carbon atoms) esters.

A molar ratio between the alcohol component and the carboxylic acid component (carboxylic acid component/alcohol component) used as the raw material monomers of the polyester resin A can be 0.80 or more and 1.20 or less.

The weight average molecular weight Mwa of the polyester resin A is 8000 or more and 100,000 or less, and preferably 12,000 or more and 45,000 or less from the viewpoint of the fixing property and the heat-resistant storage property. Furthermore, the weight average molecular weight Mwa and the weight average molecular weight Mwb of the polyester resin B can satisfy a relationship of Mwb<Mwa. Thus, the reversible phase transition structure can be easily obtained, and the low temperature fixing property of the toner and the long-term storage stability of a fixed image can be further improved.

The polyester resin A used in the present invention can have a quantity of heat of fusion (ΔH), obtained based on an area of an endothermic peak observed in temperature rise in measurement with a differential scanning calorimeter (DSC), of 100 J/g or more and 140 J/g or less. Furthermore, from the viewpoint of the low temperature fixing property of the toner, the melting point of the polyester resin A is preferably 60° C. or more and 120° C. or less and more preferably 70° C. or more and 90° C. or less.

The acid value of the polyester resin A can be 2 mg KOH/g or more and 40 mg KOH/g or less from the viewpoint of attaining a good charging characteristic of the toner. The hydroxyl value of the polyester resin A can be 2 mg KOH/g or more and 40 mg KOH/g or less from the viewpoint of the fixing property and the storage stability.

Examples of an alcohol component used for obtaining the polyester resin B include the following: Examples of a bivalent alcohol component include alkyleneoxide addition products of bisphenol A represented by the above formula (I) including a polyoxypropylene addition product of 2,2-bis(4-hydroxyphenyl)propane and a polyoxyethylene addition product of 2,2-bis(4-hydroxyphenyl)propane, ethylene glycol, 1,3-propylene glycol and neopentyl glycol. Examples of a tri- or more-valent alcohol component include sorbitol, pentaerythritol and dipentaerythritol. One of these bivalent alcohol components and polyvalent alcohol components having three or more valence may be singly used or a plurality of these compounds may be used in combination.

Examples of a carboxylic acid component used for obtaining the polyester resin B include the following: Examples of a bivalent carboxylic acid component include maleic acid, fumaric acid, phthalic acid, isophthalic acid, terephthalic acid, succinic acid, adipic acid, n-dodecenylsuccinic acid, and anhydrides or lower alkyl esters of these acids, and examples of a polyvalent carboxylic acid component having three or more valence include 1,2,4-benzenetricarboxylic acid, 2,5,7-naphthalenetricarboxylic acid, pyromellitic acid, EMPOL trimer acid, and anhydrides or lower alkyl esters of these acids.

The polyester resin can be produced by an esterification reaction or an ester exchange reaction using the alcohol component and the carboxylic acid component. For condensation polymerization, a known esterification catalyst or the like such as dibutyltin oxide can be appropriately used for accelerating the reaction.

The glass transition temperature (Tg) of the polyester resin B can be 45° C. or more and 70° C. or less from the viewpoint of the fixing property and the storage property. The softening point of the polyester resin B is preferably 80° C. or more and 130° C. or less and more preferably 90° C. or more and 120° C. or less from the viewpoint of the low temperature fixing property of the toner.

The acid value of the polyester resin B can be 2 mg KOH/g or more and 40 mg KOH/g or less from the viewpoint of attaining a good charging characteristic of the toner. The hydroxyl value of the polyester resin B can be 2 mg KOH/g or more and 40 mg KOH/g or less from the viewpoint of the fixing property and the storage stability.

In toner particles, a mass-based content ratio between the polyester resin A and the polyester resin B can be 5:95 to 40:60 from the viewpoint of the low temperature fixing property and the long-term storage stability for an image.

The toner of the present invention containing the polyester resin A and the polyester resin B has a phase separation structure at room temperature. Accordingly, various properties exhibited by the toner can have apparently similar values to those of toner properties of a toner having a phase separation structure.

The softening point of the toner can be 80° C. or more and 120° C. or less from the viewpoint of the low temperature fixing property of the toner. The weight average molecular weight of the toner can be 3000 or more and 100000 or less from the viewpoint of the fixing property and prevention of high-temperature offset.

In the present invention, the polyester resin A and the polyester resin B work as a binding resin, but any of known resins may be added as another toner binding resin as long as the effects of the present invention are not impaired.

For improving the releasability of the toner, a wax may be used in the toner as occasion demands. As the wax, hydrocarbon wax such as low molecular weight polyethylene, low molecular weight polypropylene, microcrystalline wax or paraffin wax can be used from the viewpoint of good dispersibility in the toner and high releasability. Two or more waxes may be used together if necessary.

Specific examples of the wax include the following: Biscol (registered trademark) 330-P, 550-P, 660-P and TS-200 (manufactured by Sanyo Chemical Industries, Ltd.), Hi-wax 400P, 200P, 100P, 410P, 420P, 320P, 220P, 210P and 110P (manufactured by Mitsui Chemicals, Inc.), Sasol H1, H2, C80, C105 and C77 (manufactured by Schumann Sasol Ltd.), HNP-1, HNP-3, HNP-9, HNP-10, HNP-11 and HNP-12 (manufactured by Nippon Seiro Co., Ltd.), Unilin (registered trademark) 350, 425, 550 and 700, Unicid (registered trademark) 350, 425, 550 and 700 (manufactured by Toyo Petrolite Co., Ltd.), haze wax, bees wax, rice wax, candelilla wax and carnauba wax (available from Cerarica Noda Co., Ltd.).

If the toner is produced by a grinding method, the wax can be added at the time of melting/kneading. Alternatively, the wax may be added in producing the polyester resin B.

The toner can contain the wax in a content of 1 part by mass or more and 20 parts by mass or less based on 100 parts by mass of the polyester resins A and B.

The toner of the present invention may be a magnetic toner or a non-magnetic toner. When used as a magnetic toner, magnetic iron oxide can be used as a magnetic substance. As the magnetic iron oxide, iron oxide such as magnetite, maghematite or ferrite is used. The content of the magnetic iron oxide contained in the toner is preferably 25 parts by mass or more and 45 parts by mass or less, and more preferably 30 parts by mass or more and 45 parts by mass or less based on 100 parts by mass of the polyester resins A and B.

When the toner of the present invention is used as a non-magnetic toner, any of known pigments and dyes such as carbon black may be used as a colorant. One of the pigments and dyes may be singly used or two or more of them may be used together. The content of the colorant contained in the toner is preferably 0.1 part by mass or more and 60.0 parts by mass or less and more preferably 0.5 part by mass or more and 50.0 parts by mass or less based on 100 parts by mass of the polyester resins A and B.

The toner may contain a flowability improver such as an inorganic fine powder. Examples of the flowability improver include the following: A fluorine-based resin powder such as a vinylidene fluoride fine powder or a polytetrafluoroethylene fine powder; fine powder silica such as wet process silica or dry process silica, and treated silica obtained by subjecting such silica to a surface treatment with a silane coupling agent, a titanium coupling agent, silicone oil or the like. Preferable examples of the flowability improver include a fine powder produced by vapor phase oxidation of a silicon halogen compound, dry process silica and fumed silica.

Among these, a treated silica fine powder obtained by a hydrophobization treatment of a silica fine powder produced by the vapor phase oxidation of a silicon halogen compound is suitably used. The degree of hydrophobization, measured by a methanol titration test, of the treated silica fine powder can be 30 or more and 98 or less.

An example of a hydrophobization method for a silica fine powder includes a method in which a chemical treatment is performed with an organic silicon compound reactive with or physically adsorbed on the silica fine powder. For example, a silica fine powder produced by the vapor phase oxidation of a silicon halogen compound can be treated with an organic silicon compound. Examples of the organic silicon compound include the following: hexamethyldisilazane, trimethylsilane, trimethylchlorosilane, trimethylethoxysilane, dimethyldichlorosilane, methyltrichlorosilane, allyl dimethylchlorosilane, allyl phenyl dichlorosilane, benzyl dimethylchlorosilane, bromomethyl dimethylchlorosilane, α-chloroethyl trichlorosilane, β-chloroethyl trichlorosilane, chloromethyl dimethylchlorosilane, triorganosilyl mercaptan, trimethylsilyl mercaptan, triorganosilyl acrylate, vinyldimethyl acetoxysilane, dimethyl ethoxysilane, dimethyl dimethoxysilane, diphenyl diethoxysilane, 1-hexamethyldisiloxane, 1,3-divinyltetramethyldisiloxane, 1,3-diphenyltetramethyldisiloxane, and dimethyl polysiloxane having 2 to 12 siloxane units per molecule and having, in the unit positioned at each end, one hydroxyl group bonded to Si. One of these compounds is singly used or two or more of them are used as a mixture.

The silica fine powder may be treated with silicone oil or treated with both silicone oil and the aforementioned organic silicon compound. As the silicone oil, one having viscosity at 25° C. of 30 $mm^2/s$ or more and 1000 $mm^2/s$ or less can be used. Examples include dimethyl silicone oil, methylphenyl silicone oil, α-methyl styrene-modified silicone oil, chlorophenyl silicone oil and fluorine-modified silicone oil.

Examples of a method for performing the hydrophobization treatment of a silica fine powder with silicone oil include the following: A method in which a silica fine powder having been treated with a silane coupling agent and silicone oil are directly mixed with each other by using a mixer such as a Henschel mixer; and a method in which silicone oil is sprayed onto a silica fine powder used as a base. Another example include a method in which silicone oil is dissolved or dispersed in an appropriate solvent, a silica fine powder is added thereto and mixed, and the solvent is removed. More preferably, silicone oil-treated silica is heated, after the treatment with the silicone oil, at a temperature of 200° C. or more (more preferably 250° C. or more) in an inert gas for stabilizing a coat formed on the surface thereof.

The content of the inorganic fine powder is preferably 0.01 part by mass or more and 8.0 parts by mass or less and more preferably 0.10 part by mass or more and 4.0 parts by mass or less based on 100 parts by mass of the toner particles.

The toner may further contain another external additive if necessary. Examples of the additive include a charge assisting agent, a conductivity imparting agent, a caking preventing agent, a release agent to be used in heat roller fixing, a lubricant, and resin fine particles or inorganic fine particles working as an abrasive.

Examples of the lubricant include a polyfluoroethylene powder, a zinc stearate powder and a polyvinylidene fluoride powder. Especially, a polyvinylidene fluoride powder is suitably used. Examples of the abrasive include a cerium oxide powder, a silicon carbide powder and a strontium titanate powder.

The toner of the present invention may be used as a one-component developer but can be mixed with a magnetic carrier to be used as a two-component developer. As the magnetic carrier, any of known carriers such as a ferrite carrier and a magnetic substance dispersed resin carrier (what is called a resin carrier) in which a magnetic substance is dispersed in a binding resin such as a polyester resin can be used. If the toner is mixed with a magnetic carrier to be used as a two-component developer, the toner concentration in the developer can be 2% by mass or more and 15% by mass or less.

A method for producing the toner of the present invention is not especially limited, but a grinding method can be employed from the viewpoint of obtaining a toner with much better low temperature fixing property. In employing the grinding method, since the molecular chain of the polyester resin A can easily get into the polyester resin B when the materials are mixed with shearing in the melting/kneading process, the polyester resin A and the polyester resin B can be made well compatible with each other in a fixing operation. Therefore, the low temperature fixing property of the toner can be improved.

In the conventional technique, if a toner is produced by the grinding method, it is difficult to keep the crystallizablity of a polyester resin, and therefore, when the resin becomes compatible once in the melting/kneading process, it is difficult to form a crystal segment in the toner. However, since the crystal nucleating agent is contained at the molecular end of the polyester resin A and the difference in the SP value between the polyester portion of the polyester resin A and the polyester resin B and the molecular weight of the polyester resin B are controlled, even when the grinding method is employed for the production, a toner satisfactorily having a crystal segment can be obtained.

Now, a method for obtaining the toner of the present invention by the grinding method will be described.

In a material mixing process, the polyester resin A, the polyester resin B, the colorant and the other additives and the like are weighed in prescribed amounts, as materials for the toner particles, to be blended and mixed. Examples of a mixer include a double cone mixer, a V-type mixer, a drum-type mixer, a Super mixer, a Henschel mixer, a Nauta mixer and Mechano Hybrid (manufactured by Nippon Coke & Engineering Co., Ltd.).

Next, the mixed materials are molten and kneaded so as to disperse the colorant and the like in the polyester resins. In the melting/kneading process, a pressure kneader, a batch kneader such as a Banbury mixer, or a continuous kneading machine can be used. Owing to an advantage that continuous production can be performed, a single-screw or double-screw extruder is mainly used. Examples include a KTK double-screw extruder (manufactured by Kobe Steel, Ltd.), a TEM double-screw extruder (manufactured by Toshiba Machine Co., Ltd.), a PCM kneader (manufactured by Ikegai Ltd.), a double-screw extruder (manufactured by KCK Corporation), a Ko-kneader (manufactured by Buss Co., Ltd.) and a Kneadex (manufactured by Nippon Coke & Engineering Co., Ltd.). Furthermore, a resin composition resulting from the melting/kneading may be rolled out by two rolls or the like and cooled with water or the like in a cooling process.

Subsequently, the cooled resin composition is ground in a grinding process into a desired particle size. In the grinding process, the composition is first roughly ground by using, for example, a grinder such as a crusher, a hammer mill or a feather mill, and then finely ground by using, for example, a Criptron system (manufactured by Kawasaki Heavy Industries, Ltd.), a Super Rotor (manufactured by Nisshin Engineering Inc.) a Turbo mill (manufactured by Turbo Kogyo Co., Ltd.) or an air-jet type pulverizing mill. Subsequently, the thus obtained ground product is classified, as occasion demands, by using a classifier or a screen classifier, such as Elbow-Jet (manufactured by Nittetsu Mining Co., Ltd.) employing an inertial classification system, Turboplex (manufactured by Hosokawa Micron Corporation) employing a centrifugal classification system, a TSP separator (manufactured by Hosokawa Micron Corporation) or Faculty (manufactured by Hosokawa Micron Corporation), and thus, the toner particles are obtained.

After the grinding, a surface treatment for the toner particles such as a spheroidizing treatment can be performed, if necessary, by using a hybridization system (manufactured by Nara Machinery Co., Ltd.), a mechanofusion system (manufactured by Hosokawa Micron Corporation), Faculty (manufactured by Hosokawa Micron Corporation) or Meteo Rainbow MR type (manufactured by Nippon Pneumatic Mfg. Co., Ltd.).

Furthermore, a desired additive can be sufficiently mixed by using a mixer such as a Henschel mixer as occasion demands.

The physical properties of the resins and the toner are measured as follows. In examples described later, values of the physical properties were obtained according to the following measurement methods.

<Measurement of Weight Average Molecular Weight by GPC>

A column is stabilized in a heat chamber at 40° C., and THF used as a solvent is flown to the column at this temperature at a flow rate of 1 ml/min, and then, approximately 100 μl of a THF sample solution is injected for measurement. In the measurement of the molecular weight of a sample, a molecular weight distribution of the sample is calculated based on a relationship between counted values and logarithms of a calibration curve created by using several monodisperse polystyrene standard samples. As the standard polystyrene samples used for creating the calibration curve, those having a molecular weight of approximately $10^2$ to $10^7$ manufactured by Tosoh Corporation or Showa Denko K.K. are used, and it is appropriate to use at least 10 standard polystyrene samples. Besides, an RI (refractive index) detector is used as a detector. Incidentally, a combination of a plurality of commercially available polystyrene gel columns may be used as the column, and examples of the combination include a combination of shodex GPC KF-801, 802, 803, 804, 805, 806, 807 and 800P manufactured by Showa Denko K.K., and a combination of TSKgel G1000H ($H_{XL}$), G2000H ($H_{XL}$), G3000H ($H_{XL}$), G4000H($H_{XL}$), G5000H($H_{XL}$), G6000H($H_{XL}$), G7000H ($H_{XL}$) and TSK guard column manufactured by Tosoh Corporation.

Furthermore, a sample is prepared as follows. After putting a sample in THF, the resultant is left to stand at 25° C. for several hours, and then sufficiently shook for well mixing the sample with THF (until a coalesced product of the sample is lost), and the resultant is left to stand another 12 hours or more. At that time, a time duration in which the sample is left to stand in the THF is adjusted to be 24 hours in total. Thereafter, the resulting solution is allowed to pass through a sample treatment filter (having a pore size of 0.2 μm or more and 0.5 μm or less, such as a Mishoridisk H-25-2 (manufactured by Tosoh Corporation)) so as to obtain a filtrate as a sample for the GPC. Furthermore, the concentration of the sample is adjusted to have a resin component of 0.5 mg/ml or more and 5.0 mg/ml or less.

<Measurement of Melting Points and Quantity of Heat of Fusion of Polyester Resin and Wax>

In a DSC curve measured, for each of a polyester resin and a wax, according to ASTM D3418-82 by using a differential scanning calorimeter "Q2000" (manufactured by TA Instruments Inc.), a peak temperature of the maximum endothermic peak is defined as a melting point, and the quantity of heat obtained based on the area of the peak is defined as the quantity of heat of fusion.

For temperature correction for a detection unit of the used apparatus, melting points of indium and zinc are used, and for correction of the quantity of heat, the heat of fusion of indium is used. Specifically, approximately 2 mg of a sample is precisely weighed and the weighed sample is put in an aluminum pan, and with an empty aluminum pan used as a reference, measurement is performed in a measurement temperature range of 30 to 200° C. at a temperature rise rate of 10° C./min. Incidentally, in the measurement, the temperature is once raised up to 200° C., subsequently lowered to 30° C., and thereafter, the temperature is raised again. In this second temperature rise, the maximum endothermic peak temperature of a DSC curve within the temperature range of 30 to 200° C. is obtained as a melting point, and the quantity of heat obtained based on the area of the peak is defined as the quantity of heat of fusion.

<Measurement of Tg of Polyester Resin>

The Tg of a polyester resin and a toner are measured according to ASTM D3418-82 by using a differential scanning calorimeter "Q2000" (manufactured by TA Instruments Inc.). For the temperature correction of a detection unit of the used apparatus, melting points of indium and zinc are used, and for correction of the quantity of heat, the heat of fusion of indium is used. Specifically, approximately 2 mg of a sample is precisely weighed and the weighed sample is put in an aluminum pan, and with an empty aluminum pan used as a reference, measurement is performed in a measurement range of 30 to 200° C. at a temperature rise rate of 10° C./min. Incidentally, in the measurement, the temperature is once raised up to 200° C., subsequently lowered to 30° C., and thereafter, the temperature is raised again. In this second temperature rise, change in specific heat is obtained in a temperature range of 40° C. to 100° C. A point of intersection of a differential thermal curve with a line passing through an intermediate point of a base line before and after occurrence of the change in specific heat is defined as a glass transition temperature Tg of the polyester resin.

<Measurement of Softening Points of Polyester Resin and Toner>

The softening points of a polyester resin and a toner are measured by using a constant-load extruding capillary rheometer, "flow properties evaluating apparatus, Flow Tester CFT-500D" (manufactured by Shimadzu Corporation) according to a manual accompanying the apparatus. In this apparatus, the temperature of a measurement sample filled in a cylinder is raised to melt the measurement sample while applying a constant load by a piston from above the measurement sample, and the molten measurement sample is extruded through a die disposed at the bottom of the cylinder, so as to obtain a flow curve corresponding to the relationship between the temperature and a descending level of the piston.

A "melting temperature obtained in ½ process" mentioned in the manual accompanying the "flow properties evaluating apparatus, Flow Tester CFT-500D" is set as the softening point. Incidentally, the melting temperature obtained in ½ process is a value calculated as follows: First, a value of ½ of a difference between a descending level Smax of the piston at the time point when the sample has completely flowed out and a descending level 5 min of the piston at the time point when the sample has begun to flow out is obtained (which value is represented by X; X=(Smax−Smin)/2). Then, a temperature on the flow curve at the time point when the descending level of the piston is equal to a sum of X and 5 min is defined as the melting temperature obtained in ½ process.

The measurement sample is a cylindrical sample with a diameter of approximately 8 mm, which is obtained by compression molding approximately 1.0 g of a sample by using a tablet compressing machine (such as NT-100H, manufactured by NPa System Co., Ltd.) at approximately 10 MPa for approximately 60 seconds under an environment of 25° C.

Conditions for the measurement with CFT-500D are as follows:

Test mode: Temperature rise method
Temperature rise rate: 4° C./min
Starting temperature: 50° C.
Ultimate temperature: 200° C.

<Measurement of Acid Value of Polyester Resin>

An acid value is a value in mg of potassium hydroxide necessary for neutralizing an acid contained in 1 g of a sample. The acid value of a polyester resin is measured according to JIS K 0070-1992, and specifically measured as follows.

(1) Preparation of Reagent

A phenolphthalein solution is obtained by dissolving 1.0 g of phenolphthalein in 90 ml of ethyl alcohol (95 vol %) and adding ion-exchanged water thereto to attain a total amount of 100 ml.

Seven g of special grade potassium hydroxide is dissolved in 5 ml of water, and ethyl alcohol (95 vol %) is added thereto to attain a total amount of 1 l. The resulting solution is put in an alkali-resisting vessel so as not to come into contact with a carbon dioxide gas and the like, and left to stand for 3 days, and the resulting solution is filtered to give a potassium hydroxide solution. The thus obtained potassium hydroxide solution is stored in an alkali-resisting vessel. The factor of the potassium hydroxide solution is obtained as follows: Twenty five ml of 0.1 mol/l hydrochloric acid is put in an Erlenmeyer flask, several drops of the phenolphthalein solution were added thereto, the resulting solution was titrated with the potassium hydroxide solution, and the factor is obtained based on the amount of the potassium hydroxide solution necessary for neutralization. The 0.1 mol/l hydrochloric acid is prepared according to JIS K 8001-1998 for use.

(2) Operation (A) Run Proper

A sample of a ground polyester resin is precisely weighed in an amount of 2.0 g and the weighed sample is put in a 200 ml Erlenmeyer flask, 100 ml of a mixed solution of toluene/ethanol (2:1) is added thereto, and the sample is dissolved therein over 5 hours. Subsequently, several drops of the phenolphthalein solution are added as an indicator, and the resulting solution is titrated with the potassium hydroxide solution. The end point of the titration is determined as a time point when a pale red color of the indicator has continued for approximately 30 seconds.

(B) Blank Test

The titration is performed in the same manner as described above except that a sample is not used (namely, the mixed solution of toluene/ethanol (2:1) alone is used).

(3) An acid value is calculated by substituting the obtained result in the following expression:

$$A=[(C-B)\times f\times 5.61]/S$$

wherein A represents an acid value (mg KOH/g), B represents the amount (ml) of the potassium hydroxide solution added in the blank test, C represents the amount (ml) of the potassium hydroxide solution added in the run proper, f represents the factor of the potassium hydroxide solution, and S represents the weight (g) of the sample.

<Measurement of Hydroxyl Value of Polyester Resin>

A hydroxyl value means a value in mg of potassium hydroxide necessary for neutralizing acetic acid bonded to a hydroxyl group in acetylating 1 g of a sample. The hydroxyl value of a polyester resin is measured according to JIS K 0070-1992, and specifically measured as follows.

(1) Preparation of Reagent

An acetylating reagent is obtained by putting 25 g of special grade acetic anhydride in a 100 ml measuring flask, adding pyridine thereto to attain a total amount of 100 ml, and sufficiently shaking the resulting solution. The thus obtained acetylating reagent is stored in a brown bottle so as not to come into contact with moisture, a carbon dioxide gas and the like.

A phenolphthalein solution is obtained by dissolving 1.0 g of phenolphthalein in 90 ml of ethyl alcohol (95 vol %) and adding ion-exchanged water thereto to attain a total amount of 100 ml.

Thirty five g of special grade potassium hydroxide is dissolved in 20 ml of water, and ethyl alcohol (95 vol %) is added thereto to attain a total amount of 1 l. The resulting solution is put in an alkali-resisting vessel so as not to come into contact with a carbon dioxide gas and the like, and left to stand for 3 days, and the resulting solution is filtered to give a potassium hydroxide solution. The thus obtained potassium hydroxide solution is stored in an alkali-resisting vessel. The factor of the potassium hydroxide solution is obtained as follows: Twenty five ml of 0.5 mol/l hydrochloric acid is put in an Erlenmeyer flask, several drops of the phenolphthalein solution are added thereto, the resulting solution is titrated with the potassium hydroxide solution, and the factor is obtained based on the amount of the potassium hydroxide solution necessary for neutralization. The 0.5 mol/l hydrochloric acid is prepared according to JIS K 8001-1998 for use.

(2) Operation (A) Run Proper

A sample of a ground polyester resin is precisely weighed in an amount of 1.0 g and the weighed sample is put in a 200 ml round flask, and 5.0 ml of the acetylating reagent is added thereto accurately with a whole pipette. At that time, if the sample is hard to dissolve in the acetylating reagent, a small amount of special grade toluene is added for dissolving.

With a small funnel placed on the mouth of the flask, the flask is heated with a bottom portion thereof of approximately 1 cm immersed in a glycerin bath at approximately 97° C. At this point, in order to prevent the neck of the flask from rising in the temperature due to the heat of the bath, thick paper having a round hole can be put on the base of the neck of the flask.

After 1 hour, the flask is taken out of the glycerin bath and left to stand to cool. After standing to cool, 1 ml of water is added through the funnel, and the flask is shook to hydrolyze the acetic anhydride. For further complete hydrolysis, the flask is heated again in a glycerin bath for 10 minutes. After standing to cool, the inner walls of the funnel and the flask are washed with 5 ml of ethyl alcohol.

Several drops of the phenolphthalein solution are added as an indicator, and the resulting solution is titrated with the potassium hydroxide solution.

Incidentally, the end point of the titration is determined as a time point when a pale red color of the indicator has continued for approximately 30 seconds.

(B) Blank Test

The titration is performed in the same manner as described above except that a sample of a polyester resin is not used.

(3) A hydroxyl value is calculated by substituting the obtained result in the following expression:

$$A=[\{(B-C)\times 28.05\times f\}/S]+D$$

wherein A represents a hydroxyl value (mg KOH/g), B represents the amount (ml) of the potassium hydroxide solution added in the blank test, C represents the amount (ml) of the potassium hydroxide solution added in the run proper, f represents the factor of the potassium hydroxide solution, S represents the weight (g) of the sample, and D represents an acid value (mg KOH/g) of the polyester resin.

<Measurement Method for Weight Average Particle Size (D4)>

The weight average particle size (D4) of a toner is calculated through analysis of measurement data obtained by measurement with 25000 effective measurement channels by using a precision particle size distribution measuring apparatus equipped with a 100 μm aperture tube and employing an aperture electric resistance method, "Coulter Counter Multisizer 3" (registered trademark, manufactured by Beckman Coulter, Inc.) and accompanying dedicated software for setting measurement conditions and analyzing measurement data, "Beckman Coulter Multisizer 3 Version 3.51" (manufactured by Beckman Coulter, Inc.).

As an aqueous electrolyte solution for used in the measurement, one obtained by dissolving special grade sodium chloride in ion-exchanged water into a concentration of approximately 1% by mass, such as "ISOTON II" (manufactured by Beckman Coulter, Inc.), can be used.

Incidentally, before the measurement and analysis, the dedicated software is set as follows.

In a "screen for changing standard operation method (SOM)" of the dedicated software, the total count number in the control mode is set to 50000 particles, the number of measurements is set to one, and a Kd value is set to a value obtained by using "standard particles of 10.0 μm" (Beckman Coulter, Inc.). A threshold value and noise level are automatically set by pressing a threshold value/noise level measurement button. In addition, the current is set to 1600 μA, the gain is set to 2, the aqueous electrolyte solution is set to ISOTON II, and a check is put in an item of aperture tube flush to be performed after the measurement.

In a "screen for setting conversion from pulses to particle size" of the dedicated software, a bin interval is set to logarithmic particle size, the number of particle size bins is set to 256, and a particle size range is set to 2 μm to 60 μm.

The measurement method is specifically performed as follows.

1. Approximately 200 ml of the above-described aqueous electrolyte solution is put in a 250 ml round bottom glass beaker intended for use with Multisizer 3 and the beaker is placed in a sample stand and counterclockwise stirring with a stirrer rod is carried out at 24 rotations per second. Contamination and air bubbles within the aperture tube have precedently been removed by an "aperture flush" function of the analysis software.

2. Approximately 30 ml of the above-described aqueous electrolyte solution is put in a 100 ml flat bottom glass beaker, and to this beaker, approximately 0.3 ml of a dilution prepared by three-fold by mass dilution with ion-exchanged water of "Contaminon N" (a 10 mass % aqueous solution of a neutral pH 7 detergent for cleaning precision measurement instruments, containing a nonionic surfactant, an anionic surfactant and an organic builder, manufactured by Wako Pure Chemical Industries, Ltd.) is added as dispersant.

3. In an "Ultrasonic Dispersion System Tetora 150" (Nikkaki Bios Co., Ltd.), that is, an ultrasonic disperser with an electrical output of 120 W equipped with two oscillators of oscillation frequency of 50 kHz disposed with their phases displaced by 180°, a prescribed amount of ion-exchanged water is introduced into a water tank of the ultrasonic disperser and approximately 2 ml of the Contaminon N is added to the water tank.

4. The beaker described in the item 2. is set into a beaker holder hole of the ultrasonic disperser and the ultrasonic disperser is started. The height of the beaker is adjusted in such a manner that the resonant state of the surface of the aqueous electrolyte solution within the beaker is at the maximum level.

5. With the aqueous electrolyte solution within the beaker set as described in the item 4. irradiated with ultrasonic waves, approximately 10 mg of toner is added to the aqueous electrolyte solution in small aliquots to be dispersed therein. The ultrasonic dispersion treatment is continued for another 60 seconds. Incidentally, the water temperature in the water tank is appropriately controlled during the ultrasonic dispersion to be 10° C. or more and 40° C. or less.

6. The aqueous electrolyte solution containing the dispersed toner as described in the item 5. is added, by using a pipette, dropwise into the round bottom beaker set in the sample stand as described in the item 1. so as to make adjustment for attaining a measurement concentration of approximately 5%. The measurement is then performed until the number of measured particles reaches 50000.

7. The measurement data is analyzed by the above-described dedicated software accompanying the apparatus, and the weight average particle size (D4) is calculated. Incidentally, an "average size" shown in an analysis/volume statistical value (arithmetic mean) screen with graph/volume % set in the dedicated software corresponds to the weight average particle size (D4).

EXAMPLES

In examples described below, a term "part(s)" is used in mass basis.

<Production of Polyester Resin A1-1>

A reaction vessel equipped with a nitrogen introducing tube, a dehydrating tube, a stirrer and a thermocouple was charged with 1,10-decanediol used as an alcohol monomer and 1,10-decanedioic acid used as a carboxylic acid monomer in amounts shown in Table 1. Then, tin dioctylate was added as a catalyst in an amount of 1 part by mass based on 100 parts by mass of the total amount of the monomers, and the resulting solution was heated to 140° C. under a nitrogen atmosphere so as to carry out a reaction under normal pressure for 6 hours with water distilled off. Subsequently, the reaction was carried out while raising the temperature to 200° C. at 10° C./hr., and after performing the reaction for 2 hours after reaching the temperature of 200° C., the pressure within the reaction vessel was reduced to 5 kPa or less, and the reaction was carried out for 3 hours at 200° C.

Thereafter, the pressure within the reaction vessel was gradually released to be restored to the normal pressure, a crystal nucleating agent (n-octadecanoic acid) shown in Table 1 was added thereto, and the reaction was carried out at 200° C. under the normal pressure for 2 hours. Then, the pressure within the reaction vessel was reduced again to 5 kPa or less, and the reaction was carried out at 200° C. for 3 hours, and thus, a polyester resin A1-1 was obtained. In a mass spectrum of the thus obtained resin A1-1 measured by using MALDI-TOFMS, a peak derived from a composition containing n-octadecanoic acid bonded to a molecular end of the resin A was found, and therefore, it was confirmed that the crystal nucleating agent was bonded to the molecular end of the resin A. The physical properties of the polyester resin A1-1 are shown in Table 2.

<Production of polyester resins A1-2, A1-3 and A2 to A15>

Polyester resins A1-2, A1-3, A2 to A15 were obtained in the same manner as the polyester resin A1-1 except that monomers, crystal nucleating agents and contents thereof were changed as shown in Table 1. The thus obtained resins A1-2, A1-3, A2 to A11, A13 and A15 were measured for mass spectra by using MALDI-TOFMS, resulting in finding peaks derived from the compositions containing the crystal nucleating agents bonded to the ends of polyester portions and confirming that the crystal nucleating agents were bonded to the molecular ends.

The physical properties of the polyester resins A1-2, A1-3 and A2 to A15 are shown in Table 2.

TABLE 1

| | Monomer composition | | | | | | | |
|---|---|---|---|---|---|---|---|---|
| | Alcohol component | SP value | Molar ratio | Acid component | SP value | Molar ratio | Crystal nucleating agent | Molar ratio |
| Polyester resin A1-1 | 1,10-decanediol | 9.84 | 100.0 | 1,10-decanedioic acid | 9.97 | 100.0 | n-ocatadecanoic acid | 4.0 |
| Polyester resin A1-2 | 1,10-decanediol | 9.84 | 100.0 | 1,10-decanedioic acid | 9.97 | 100.0 | n-ocatadecanoic acid | 0.4 |
| Polyester resin A1-3 | 1,10-decanediol | 9.84 | 100.0 | 1,10-decanedioic acid | 9.97 | 100.0 | n-ocatadecanoic acid | 10.0 |
| Polyester resin A2 | 1,10-decanediol | 9.84 | 100.0 | 1,8-octanedioic acid | 10.41 | 100.0 | 1-octadecanol | 4.0 |
| Polyester resin A3 | 1,10-decanediol | 9.84 | 100.0 | 1,12-dodecanedioic acid | 9.66 | 100.0 | n-ocatadecanoic acid | 4.0 |
| Polyester resin A4 | 1,10-decanediol | 9.84 | 100.0 | 1,8-octanedioic acid | 10.41 | 100.0 | n-ocatadecanoic acid | 4.0 |
| Polyester resin A5 | 1,10-decanediol | 9.84 | 100.0 | 1,6-hexanedioic acid | 11.10 | 100.0 | n-ocatadecanoic acid | 4.0 |
| Polyester resin A6 | 1,12-dodecanediol | 9.57 | 100.0 | 1,14-tetradecanedioic acid | 9.44 | 100.0 | n-ocatadecanoic acid | 4.0 |
| Polyester resin A7 | 1,10-decanediol | 9.84 | 100.0 | 1,6-hexanedioic acid | 11.10 | 100.0 | n-dodecanoic acid | 4.0 |
| Polyester resin A8 | 1,12-dodecanediol | 9.57 | 100.0 | 1,14-tetradecanedioic acid | 9.44 | 100.0 | n-octacosanoic acid | 4.0 |
| Polyester resin A9 | 1,18-octadecanediol | 9.08 | 100.0 | 1,18-octadecanedioic acid | 9.14 | 100.0 | n-octacosanoic acid | 4.0 |
| Polyester resin A10 | 1,10-decanediol | 9.84 | 100.0 | 1,6-hexanedioic acid | 11.10 | 100.0 | n-octanoic acid | 4.0 |
| Polyester resin A11 | 1,18-octadecanediol | 9.08 | 100.0 | 1,18-octadecanedioic acid | 9.14 | 100.0 | n-dotriacontanoic acid | 4.0 |
| Polyester resin A12 | 1,10-decanediol | 9.84 | 100.0 | 1,6-hexanedioic acid | 11.10 | 100.0 | — | 0.0 |
| Polyester resin A13 | 1,8-octanediol | 10.23 | 100.0 | 1,4-butanedioic acid | 12.35 | 100.0 | n-dodecanoic acid | 4.0 |
| Polyester resin A14 | 1,8-octanediol | 10.23 | 100.0 | 1,4-butanedioic acid | 12.35 | 100.0 | — | 0.0 |
| Polyester resin A15 | 1,6-hexanediol | 10.83 | 112.0 | 1,12-dodecanedioic acid | 9.66 | 100.0 | n-ocatadecanoic acid | 16.0 |

TABLE 2

| | Physical properties | | | | | |
|---|---|---|---|---|---|---|
| | SP value (cal/cm$^3$)$^{1/2}$ | Melting point ° C. | ΔH J/g | Weight average molecular weight — | Acid value mgKOH/g | Hydroxyl value mgKOH/g |
| Polyester resin A1-1 | 9.91 | 76 | 125 | 19000 | 2 | 14 |
| Polyester resin A1-2 | 9.91 | 76 | 125 | 19000 | 2 | 22 |
| Polyester resin A1-3 | 9.91 | 76 | 125 | 19000 | 2 | 6 |
| Polyester resin A2 | 10.13 | 71 | 115 | 17000 | 3 | 18 |
| Polyester resin A3 | 9.75 | 81 | 130 | 45000 | 2 | 14 |
| Polyester resin A4 | 10.13 | 71 | 115 | 12000 | 2 | 14 |
| Polyester resin A5 | 10.47 | 67 | 108 | 16000 | 4 | 16 |
| Polyester resin A6 | 9.51 | 91 | 130 | 20000 | 2 | 14 |
| Polyester resin A7 | 10.47 | 67 | 110 | 16000 | 4 | 16 |
| Polyester resin A8 | 9.51 | 91 | 130 | 20000 | 2 | 14 |
| Polyester resin A9 | 9.11 | 95 | 135 | 25000 | 2 | 14 |
| Polyester resin A10 | 10.47 | 67 | 105 | 16000 | 5 | 18 |
| Polyester resin A11 | 9.11 | 95 | 136 | 25000 | 2 | 14 |
| Polyester resin A12 | 10.47 | 67 | 95 | 16000 | 6 | 18 |
| Polyester resin A13 | 11.29 | 60 | 88 | 16000 | 7 | 18 |
| Polyester resin A14 | 11.29 | 60 | 78 | 16000 | 7 | 18 |

TABLE 2-continued

| | Physical properties | | | | | |
|---|---|---|---|---|---|---|
| | SP value (cal/cm$^3$)$^{1/2}$ | Melting point ° C. | ΔH J/g | Weight average molecular weight — | Acid value mgKOH/g | Hydroxyl value mgKOH/g |
| Polyester resin A15 | 10.25 | 70 | 108 | 11000 | 1 | 14 |

Each SP value shown in the table is the SP value of a polyester portion of the corresponding polyester resin.

<Production of Polyester Resin B1>

A reaction vessel equipped with a nitrogen introducing tube, a dehydrating tube, a stirrer and a thermocouple was charged with monomers in blending amounts shown in Table 3, and dibutyltin was added thereto as a catalyst in an amount of 1.5 parts by mass based on 100 parts by mass of the total amount of the monomers. Subsequently, the temperature was rapidly raised to 180° C. under a nitrogen atmosphere and normal pressure, and polycondensation was carried out with water distilled while heating from 180° C. to 210° C. at a rate of 10° C./hr. When the temperature of 210° C. was achieved, the pressure within the reaction vessel was reduced to 5 kPa or less, and the polycondensation was carried out under conditions of 210° C. and 5 kPa or less, and thus, a polyester resin B1 was obtained. At that time, polymerization time was adjusted so that the resulting polyester resin B1 could attain a softening point with a value shown in Table 4 (100° C.). The physical properties of the polyester resin B are shown in Table 4.

<Production of Polyester Resins B2 to B13>

Polyester resins B2 to B13 were obtained in the same manner as the polyester resin B1 except that monomers and the contents thereof were changed as shown in Table 3. The physical properties of the polyester resins B2 to B13 are shown in Table 4.

TABLE 3

| | Acid (part(s) by mol) | | | | | Alcohol (part(s) by mol) | | | | |
|---|---|---|---|---|---|---|---|---|---|---|
| | Monomer species | | | | | | | | | |
| | TPA | IPA | TMA | FA | DSA | EPA-PO | EPA-EO | EG | PG | NPG |
| | SP value | | | | | | | | | |
| | 10.28 | 10.28 | 11.37 | 11.10 | 9.33 | 9.51 | 9.74 | 14.11 | 12.70 | 8.37 |
| Polyester resin B1 | 89 | 0 | 0 | 0 | 0 | 44 | 38 | 18 | 0 | 0 |
| Polyester resin B2 | 100 | 0 | 4 | 2 | 0 | 44 | 36 | 20 | 0 | 0 |
| Polyester resin B3 | 85 | 0 | 0 | 0 | 0 | 44 | 38 | 16 | 0 | 0 |
| Polyester resin B4 | 100 | 0 | 0 | 0 | 0 | 0 | 0 | 42 | 0 | 63 |
| Polyester resin B5 | 90 | 0 | 6 | 0 | 0 | 65 | 35 | 7 | 0 | 0 |
| Polyester resin B6 | 90 | 0 | 0 | 2 | 0 | 46 | 38 | 14 | 0 | 0 |
| Polyester resin B7 | 90 | 0 | 6 | 0 | 0 | 65 | 35 | 7 | 0 | 0 |
| Polyester resin B8 | 74 | 0 | 0 | 0 | 0 | 65 | 35 | 0 | 0 | 0 |
| Polyester resin B9 | 90 | 0 | 0 | 2 | 0 | 46 | 38 | 14 | 0 | 0 |
| Polyester resin B10 | 64 | 0 | 0 | 0 | 0 | 100 | 0 | 0 | 0 | 0 |
| Polyester resin B11 | 65 | 0 | 6 | 0 | 0 | 65 | 35 | 0 | 0 | 0 |
| Polyester resin B12 | 66 | 30 | 0 | 0 | 18 | 105 | 75 | 0 | 0 | 0 |
| Polyester resin B13 | 1 | 0 | 0.36 | 0 | 0 | 0 | 0 | 0 | 3 | 0 |

TPA: Terephthalic acid

IPA: Isophthalic acid

TMA: Trimellitic acid

FA: Fumaric acid

BPA-PO: Addition product of bisphenol A and 2 mol propylene oxide

BPA-EO: Addition product of bisphenol A and 2 mol ethylene oxide

EG: Ethylene glycol

PG: Propylene glycol

TABLE 4

| | SP value $(cal/cm^3)^{1/2}$ | Weight average molecular weight Mwb | Tg ° C. | Softening point ° C. | Acid value mgKOH/g | Hydroxyl value mgKOH/g |
|---|---|---|---|---|---|---|
| Polyester resin B1 | 10.36 | 6000 | 54 | 100 | 12 | 25 |
| Polyester resin B2 | 10.44 | 9000 | 56 | 110 | 18 | 27 |
| Polyester resin B3 | 10.32 | 6000 | 54 | 100 | 12 | 22 |
| Polyester resin B4 | 10.48 | 9000 | 56 | 115 | 12 | 32 |
| Polyester resin B5 | 10.10 | 4000 | 54 | 85 | 20 | 20 |
| Polyester resin B6 | 10.29 | 45000 | 58 | 115 | 14 | 22 |
| Polyester resin B7 | 10.10 | 3200 | 53 | 82 | 20 | 20 |
| Polyester resin B8 | 9.88 | 92000 | 60 | 128 | 18 | 19 |
| Polyester resin B9 | 10.29 | 120000 | 62 | 132 | 18 | 22 |
| Polyester resin B10 | 9.81 | 3200 | 53 | 82 | 18 | 18 |
| Polyester resin B11 | 9.92 | 92000 | 60 | 128 | 22 | 18 |
| Polyester resin B12 | 9.81 | 2800 | 51 | 79 | 10 | 16 |
| Polyester resin B13 | 12.04 | 4200 | 58 | 96 | 40 | 55 |

Example 1

| | |
|---|---|
| Polyester resin A1-1 | 20.0 parts by mass |
| Polyester resin B1 | 80.0 parts by mass |
| Carbon black | 5.0 parts by mass |
| Fischer-Tropsch wax (DSC peak temperature: 105° C.) | 5.0 parts by mass |
| Aluminum 3,5-di-t-butylsalicylate compound | 0.5 part by mass |

The above-described materials were mixed by using a Henschel mixer (FM-75, manufactured by Mitsui Miike Chemical Engineering Machinery Co., Ltd.), and the resulting mixture was kneaded by using a double-screw kneader (manufactured by Ikegai Ltd., PCM-30) under conditions of a rotation speed of 3.3 $s^{-1}$ and a kneading temperature of 120° C. The thus kneaded product was cooled, and roughly ground by using a hammer mill into a size of 1 mm or less to give a roughly ground product. The roughly ground product was finely ground by using a mechanical grinder (manufactured by Turbo Kogyo Co., Ltd., T-250). The thus obtained finely ground powder was classified by using a multiple classifier employing Coanda effect, thereby obtaining negatively chargeable toner particles with a weight average particle size of 7.0 μm.

To 100 parts by mass of the obtained toner particles, 1.0 part by mass of titanium oxide fine particles, which had been surface treated with 15 mass % isobutyl trimethoxysilane and had an average particle size of primary particles of 50 nm, and 0.8 part by mass of hydrophobic silica fine particles, which had been surface treated with 20 mass % hexamethyldisilazane and had an average particle size of primary particles of 16 nm, were added, and the resulting mixture was mixed by using a Henschel mixer (manufactured by Mitsui Miike Chemical Engineering Machinery Co., Ltd., FM-75), thereby obtaining a toner 1.

The various physical properties of the toner 1 are shown in Table 5.

For evaluation of the example, a commercially available color laser printer, Color Laser Jet CP4525 (manufactured by HP) was used. The toner produced in this example was used for making evaluations as follows.

(1) High Speed Fixing Property

A fixer was taken out of the aforementioned evaluation apparatus, and an external fixer in which a fixing temperature, a fixing nip pressure and a process speed for a fixing apparatus could be arbitrarily set was used instead. As a recording medium, color laser copier paper (manufactured by Cannon Inc., 80 $g/m^2$) was used. Then, a product toner was extracted from a commercially available black cartridge, the inside of the cartridge was cleaned with an air brush and then the cartridge was filled with 150 g of the toner 1. Incidentally, in respective stations for magenta, yellow and cyan, magenta, yellow and cyan cartridges from which product toners had been extracted and for which a toner residual amount detecting mechanism was disabled were inserted.

An unfixed black image having a toner carrying amount of 0.6 $mg/cm^2$ was output under an environment of a temperature of 23° C. and relative humidity of 50%.

With the fixing temperature of the fixer set to 150° C., the process speed was increased in a range from 300 mm/sec to 500 mm/sec by 20 mm/sec, so as to fix the unfixed black image at each process speed. Each of the thus obtained black images was rubbed through 5 reciprocations by using lens-cleaning paper with a load of approximately 100 g applied, and a point where a ratio of density decrease of the image resulting from the rubbing was 10% or less was set as the maximum fixable process speed. As the maximum fixable process speed is higher, the toner is better in the high speed fixing property. The result of the evaluation is shown in Table 6. In the present invention, a toner evaluated as C or higher grade is regarded as an allowable level.

A: The maximum fixable process speed is 400 mm/sec or more.

B: The maximum fixable process speed is 350 mm/sec or more and less than 400 mm/sec.

C: The maximum fixable process speed is 300 mm/sec or more and less than 350 mm/sec.

D: The maximum fixable process speed is less than 300 mm/sec.

(2) Low Pressure Fixing Property

In the aforementioned fixing test, with the fixing temperature of the fixer set to 150° C., the fixing nip pressure was increased in a range from 0.08 MPa to 0.24 MPa by 0.02 MPa, so as to fix the unfixed black image at each fixing pressure. Each of the thus obtained black images was rubbed through 5 reciprocations by using lens-cleaning paper with a load of approximately 100 g applied, and a point where a ratio of density decrease of the image resulting from the rubbing was 10% or less was set as the minimum fixable fixing nip surface pressure. As the minimum fixable fixing nip surface pressure is lower, the toner is better in the low pressure fixing property. The result of the evaluation is shown in Table 6. In the present invention, a toner evaluated as C or higher grade is regarded as an allowable level.

A: The minimum fixable fixing nip surface pressure is less than 0.10 MPa.

B: The minimum fixable fixing nip surface pressure is 0.10 MPa or more and less than 0.14 MPa.

C: The minimum fixable fixing nip surface pressure is 0.14 MPa or more and less than 0.20 MPa.

D: The minimum fixable fixing nip surface pressure is 0.20 MPa or more.

(3) Bending Test after High Temperature Exposure

In the aforementioned fixing test, the unfixed black image was fixed at a fixing temperature of 150° C., at a fixing nip pressure of 0.25 MPa and at a process speed of 200 mm/sec. The thus obtained black image was left to stand for 7 days in an environmental test laboratory at a temperature of 40° C. and relative humidity of 50%, and thereafter, the transfer material carrying the fixed image was bent in an image carrying part. As bending conditions, a flat weight was used for applying a load of 100 g to the bent portion and the weight was moved through 5 reciprocations. Thereafter, the bent portion of the image carrying part was rubbed through 5 reciprocations by using lens-cleaning paper with a load of approximately 100 g applied, and a ratio of density decrease of the image resulting from the rubbing was measured. The result of the evaluation is shown in Table 6. In the present invention, a toner evaluated as C or higher grade is regarded as an allowable level.

A: The ratio of density decrease is less than 5%.

B: The ratio of density decrease is 5% or more and less than 10%.

C: The ratio of density decrease is 10% or more and less than 15%.

D: The ratio of density decrease is 15% or more and less than 20%.

E: The ratio of density decrease is 20% or more.

(4) Long-Term Storage Stability (Curling Property Evaluation)

In the aforementioned fixing test, the unfixed black image was fixed at a fixing temperature of 150° C., at a fixing nip pressure of 0.25 MPa and at a process speed of 200 mm/sec. The thus obtained black image was left to stand for 30 days in an environmental test laboratory at a temperature of 40° C. and relative humidity of 50%. Thereafter, the image was placed on a flat table with its one longitudinal side fixed thereon with a tape. Here, an angle formed when the other side curled up was measured for evaluating the curling property. As the angle is smaller, the fixed image can be said to have a better long-term storage property. The result of the evaluation is shown in Table 6. In the present invention, a toner evaluated as C or higher grade is regarded as an allowable level.

A: The angle is less than 10°.

B: The angle is 10° or more and less than 20°.

C: The angle is 20° or more and less than 30°.

D: The angle is 30° or more and less than 40°.

E: The angle is 40° or more.

In all the evaluations described above, the toner of Example 1 showed good results.

Examples 2 to 19

Toners 2 to 19 were obtained in the same manner as in Example 1 except that the compositions of materials were changed as shown in Table 5. The physical properties of the toners 2 to 19 are shown in Table 5. Furthermore, the toners were evaluated in the same manner as in Example 1, and the results are shown in Table 6.

Comparative Examples 1 to 8

Toners 20 to 27 were obtained in the same manner as in Example 1 except that the compositions of materials were changed as shown in Table 5. The physical properties of the toners 20 to 27 are shown in Table 5. Furthermore, the toners were evaluated in the same manner as in Example 1, and the results are shown in Table 6.

TABLE 5

| | | Polyester resin A | | Polyester resin B | | | | | | |
|---|---|---|---|---|---|---|---|---|---|---|
| | Toner No. | No | SP value Sa | No | Mwb | SP value Sb | Sb − Sa | A:B | Tm ° C. | Mw — |
| Example 1 | Toner 1 | A1-1 | 9.91 | B1 | 6000 | 10.36 | 0.45 | 20:80 | 95 | 8600 |
| Example 2 | Toner 2 | A1-2 | 9.91 | B1 | 6000 | 10.36 | 0.45 | 20:80 | 95 | 8600 |
| Example 3 | Toner 3 | A1-3 | 9.91 | B1 | 6000 | 10.36 | 0.45 | 20:80 | 95 | 8600 |
| Example 4 | Toner 4 | A2 | 10.13 | B1 | 6000 | 10.36 | 0.23 | 20:80 | 94 | 8200 |
| Example 5 | Toner 5 | A3 | 9.75 | B2 | 9000 | 10.44 | 0.69 | 20:80 | 105 | 16500 |
| Example 6 | Toner 6 | A4 | 10.13 | B3 | 6000 | 10.32 | 0.19 | 20:80 | 94 | 8500 |
| Example 7 | Toner 7 | A3 | 9.75 | B4 | 9000 | 10.48 | 0.73 | 20:80 | 108 | 16000 |
| Example 8 | Toner 8 | A5 | 10.47 | B5 | 4000 | 10.10 | −0.37 | 20:80 | 81 | 6400 |
| Example 9 | Toner 9 | A6 | 9.51 | B6 | 45000 | 10.29 | 0.78 | 20:80 | 110 | 40000 |
| Example 10 | Toner 10 | A7 | 10.47 | B5 | 4000 | 10.10 | −0.37 | 20:80 | 81 | 6400 |
| Example 11 | Toner 11 | A8 | 9.51 | B6 | 45000 | 10.29 | 0.78 | 20:80 | 110 | 40000 |
| Example 12 | Toner 12 | A7 | 10.47 | B7 | 3200 | 10.10 | −0.37 | 20:80 | 84 | 5800 |
| Example 13 | Toner 13 | A9 | 9.11 | B8 | 92000 | 9.88 | 0.77 | 20:80 | 121 | 79000 |
| Example 14 | Toner 14 | A7 | 10.47 | B7 | 3200 | 10.10 | −0.37 | 8:92 | 81 | 5000 |
| Example 15 | Toner 15 | A9 | 9.11 | B8 | 92000 | 9.88 | 0.77 | 36:64 | 116 | 68000 |
| Example 16 | Toner 16 | A7 | 10.47 | B7 | 3200 | 10.10 | −0.37 | 4:96 | 81 | 4500 |
| Example 17 | Toner 17 | A9 | 9.11 | B8 | 92000 | 9.88 | 0.77 | 42:58 | 114 | 64000 |
| Example 18 | Toner 18 | A10 | 10.47 | B7 | 3200 | 10.10 | −0.37 | 20:80 | 80 | 5800 |
| Example 19 | Toner 19 | A11 | 9.11 | B8 | 92000 | 9.88 | 0.77 | 20:80 | 121 | 79000 |
| Comparative Example 1 | Toner 20 | A12 | 10.47 | B7 | 3200 | 10.10 | −0.37 | 20:80 | 80 | 5800 |
| Comparative Example 2 | Toner 21 | A8 | 9.51 | B9 | 120000 | 10.29 | 0.78 | 20:80 | 124 | 102000 |
| Comparative Example 3 | Toner 22 | A7 | 10.47 | B10 | 3200 | 9.81 | −0.66 | 20:80 | 80 | 6000 |

TABLE 5-continued

| | Toner No. | Polyester resin A No | Polyester resin A SP value Sa | Polyester resin B No | Polyester resin B Mwb | Polyester resin B SP value Sb | Sb − Sa | A:B | Tm ° C. | Mw — |
|---|---|---|---|---|---|---|---|---|---|---|
| Comparative Example 4 | Toner 23 | A9 | 9.11 | B11 | 92000 | 9.92 | 0.81 | 20:80 | 122 | 740000 |
| Comparative Example 5 | Toner 24 | A13 | 11.29 | B10 | 3200 | 9.81 | −1.48 | 20:80 | 81 | 5800 |
| Comparative Example 6 | Toner 25 | A13 | 11.29 | B12 | 2800 | 9.81 | −1.48 | 20:80 | 79 | 5500 |
| Comparative Example 7 | Toner 26 | A14 | 11.29 | B12 | 2800 | 9.81 | −1.48 | 5:95 | 79 | 5500 |
| Comparative Example 8 | Toner 27 | A15 | 10.25 | B13 | 4200 | 12.04 | 1.79 | 50:50 | 96 | 7600 |

TABLE 6

| | Toner No. | High speed fixing property (Process speed) | Low pressure fixing property (Fixing pressure) | Bending test (Rate of density decrease) | Long-term storage stability (Curing angle) |
|---|---|---|---|---|---|
| Example 1 | Toner 1 | A(420) | A(0.08) | A(0) | A(2) |
| Example 2 | Toner 2 | A(420) | A(0.08) | A(0) | A(2) |
| Example 3 | Toner 3 | A(420) | A(0.08) | A(0) | A(2) |
| Example 4 | Toner 4 | A(420) | A(0.08) | A(2) | A(2) |
| Example 5 | Toner 5 | A(400) | A(0.08) | A(0) | A(2) |
| Example 6 | Toner 6 | A(420) | A(0.08) | A(2) | B(10) |
| Example 7 | Toner 7 | A(400) | B(0.10) | A(0) | A(0) |
| Example 8 | Toner 8 | A(420) | A(0.08) | B(5) | B(15) |
| Example 9 | Toner 9 | B(380) | B(0.12) | A(0) | A(2) |
| Example 10 | Toner 10 | A(420) | A(0.08) | B(5) | B(18) |
| Example 11 | Toner 11 | B(380) | B(0.12) | A(0) | A(2) |
| Example 12 | Toner 12 | A(420) | A(0.08) | B(7) | C(22) |
| Example 13 | Toner 13 | B(360) | C(0.14) | A(0) | A(2) |
| Example 14 | Toner 14 | A(420) | A(0.08) | B(8) | C(25) |
| Example 15 | Toner 15 | B(360) | C(0.16) | A(0) | A(2) |
| Example 16 | Toner 16 | A(420) | A(0.08) | C(10) | C(25) |
| Example 17 | Toner 17 | C(340) | C(0.18) | A(0) | A(2) |
| Example 18 | Toner 18 | A(420) | A(0.08) | C(12) | C(28) |
| Example 19 | Toner 19 | C(320) | C(0.14) | A(0) | A(5) |
| Comparative Example 1 | Toner 20 | B(380) | B(0.10) | E(20) | D(30) |
| Comparative Example 2 | Toner 21 | C(340) | D(0.20) | B(5) | B(10) |
| Comparative Example 3 | Toner 22 | B(380) | B(0.10) | D(15) | D(36) |
| Comparative Example 4 | Toner 23 | D(240) | D(0.22) | B(5) | B(10) |
| Comparative Example 5 | Toner 24 | B(380) | B(0.10) | D(18) | D(38) |
| Comparative Example 6 | Toner 25 | B(380) | B(0.10) | D(18) | D(38) |
| Comparative Example 7 | Toner 26 | B(360) | B(0.10) | E(24) | E(45) |
| Comparative Example 8 | Toner 27 | B(360) | D(0.32) | E(20) | B(10) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-141022, filed Jun. 22, 2012 which is hereby incorporated by reference herein in its entirety.

What is claimed is:

1. A toner comprising toner particles, each of which contains a polyester resin A, a polyester resin B and a colorant, wherein:

the polyester resin A has a polyester portion including a segment capable of forming a crystal structure and a crystal nucleating agent segment, which is bonded to an end of the polyester portion, the polyester resin A is a crystalline polyester resin, the crystal nucleating agent segment is formed by reacting (i) a compound having a hydrocarbon segment as a principal chain and having one functional group reactive with the end of the polyester portion, with (ii) the end of the polyester portion, and the polyester resin B is a resin which is free of any segments capable of forming a crystal structure, a THF soluble matter of the polyester resin B has a weight average molecular weight Mwb of 3000 or more and 100000 or less, and wherein:

when an SP value of the polyester portion of the polyester resin A is represented by Sa $((cal/cm^3)^{1/2})$, an SP value of the polyester resin B is represented by Sb $((cal/cm^3)^{1/2})$, the SP values Sa and Sb satisfy the following relationships:

$$9.00 \leq Sa \leq 10.50$$

$$-0.40 \leq Sb - Sa \leq 0.80.$$

2. The toner according to claim 1, wherein a mass-based content ratio between the polyester resin A and the polyester resin B in the toner particles is 5:95 to 40:60.

3. The toner according to claim 1, wherein the crystal nucleating agent segment is derived from at least one compound selected from the group consisting of aliphatic carboxylic acids having 10 or more and 30 or less carbon atoms and aliphatic alcohols having 10 or more and 30 or less carbon atoms.

4. The toner according to claim 1, wherein when a weight average molecular weight of a THF soluble matter of the polyester resin A is represented by Mwa, the Mwa and the Mwb satisfy a relationship of Mwb<Mwa.

5. The toner according to claim 1, wherein the polyester resin A has a quantity of heat of fusion (ΔH), obtained based on an area of an endothermic peak observed in temperature rise in measurement with a differential scanning calorimeter (DSC), of 100 J/g or more and 140 J/g or less.

6. The toner according to claim 1, wherein the polyester resin A has a melting point of 60° C. or more and 120° C. or less.

* * * * *